US010916204B2

(12) United States Patent
An et al.

(10) Patent No.: US 10,916,204 B2
(45) Date of Patent: Feb. 9, 2021

(54) ELECTROLUMINESCENT DISPLAY AND DRIVING METHOD THEREOF

(71) Applicant: LG DISPLAY CO., LTD., Seoul (KR)

(72) Inventors: Jooyoung An, Paju-si (KR); Hyojung Park, Paju-si (KR); Jeisung Lee, Paju-si (KR); Euiyeol Oh, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 64 days.

(21) Appl. No.: 16/204,143

(22) Filed: Nov. 29, 2018

(65) Prior Publication Data

US 2019/0164503 A1 May 30, 2019

(30) Foreign Application Priority Data

Nov. 30, 2017 (KR) ..... 10-2017-0163109

(51) Int. Cl.

| | |
|---|---|
| ***G09G 3/3266*** | (2016.01) |
| ***G09G 3/3291*** | (2016.01) |
| ***G09G 3/3233*** | (2016.01) |
| ***G09G 3/3258*** | (2016.01) |
| ***G09G 3/20*** | (2006.01) |

(52) U.S. Cl.

CPC ..... *G09G 3/3291* (2013.01); *G09G 3/20* (2013.01); *G09G 3/3233* (2013.01); *G09G 3/3258* (2013.01); *G09G 3/3266* (2013.01); *G09G 2300/043* (2013.01); *G09G 2310/08* (2013.01); *G09G 2320/045* (2013.01)

(58) Field of Classification Search

CPC ..... G09G 3/3291; G09G 3/20; G09G 3/3233
USPC ..... 345/76, 690
See application file for complete search history.

(56) References Cited

U.S. PATENT DOCUMENTS

| | | | | |
|---|---|---|---|---|
| 7,208,888 | B2 * | 4/2007 | Lovato | H05B 45/20 315/308 |
| 7,688,292 | B2 * | 3/2010 | Park | G09G 3/3233 345/82 |
| 8,299,716 | B2 * | 10/2012 | Melzner | H05B 45/40 315/113 |
| 8,390,653 | B2 * | 3/2013 | Miwa | G09G 3/3233 345/690 |
| 2014/0320544 | A1 * | 10/2014 | Kim | G09G 3/3233 345/690 |
| 2015/0042703 | A1 * | 2/2015 | Chaji | G09G 3/3233 345/694 |
| 2016/0210897 | A1 * | 7/2016 | Jun | G09G 3/3233 |
| 2016/0307490 | A1 * | 10/2016 | Lee | G09G 3/2022 |
| 2017/0206836 | A1 * | 7/2017 | Kim | G09G 3/3233 |
| 2018/0315801 | A1 * | 11/2018 | Matsueda | H01L 27/3218 |

FOREIGN PATENT DOCUMENTS

| | | | |
|---|---|---|---|
| KR | 10-2014-0076468 | A | 6/2014 |
| KR | 10-2015-0026048 | A | 3/2015 |

* cited by examiner

*Primary Examiner* — Calvin C Ma
(74) *Attorney, Agent, or Firm* — Polsinelli PC

(57) ABSTRACT

Disclosed are an electroluminescent display and a driving method thereof, the method comprising: generating a predicted value, indicating a degree of degradation of pixels, by accumulating pixel data of an input image at each pixel: and generating a compensation value by adjusting the predicted value to a current measurement value which is obtained by measuring a current in a power line connected to the pixels. Compensation data, which is to be written into each of the pixels, is generated by modulating the pixel data with the compensation value.

17 Claims, 4 Drawing Sheets

ELECTROLUMINESCENT DISPLAY AND DRIVING METHOD THEREOF

CROSS REFERENCE TO RELATED APPLICATION

This application claims the benefit of Korean Patent Application No. 10-2017-0163109 filed on Nov. 30, 2017, the entire contents of which is incorporated herein by reference for all purposes as if fully set forth herein.

BACKGROUND

Field of the Disclosure

The present disclosure relates to an electroluminescent display including a driving device for driving pixels.

Description of the Background

An electroluminescent display is classified as an inorganic light emitting display and an organic light emitting display depending on a material of an emission layer. An active matrix-type organic light emitting display includes an Organic Light Emitting Diode (OLED), has a fast response speed and a wide viewing angle and produces brightness with high luminous efficiency.

Each pixel of an organic light emitting display includes an OLED and a driving device for driving an OLED by supplying current to the OLED according to a gate-source voltage. An OLED of the organic light emitting display includes an anode, a cathode, and an organic compound layer formed between the anode and the cathode. The organic compound layer are composed of a hole injection layer HIL, a hole transport layer HTL, an emission layer EML, an electron transport layer ETL, and an electron injection layer EIL, which are stacked between an anode and a cathode. If current flows in the OLED, a hole passing through the HTL and an electrode passing through the ETL move to the EML to form an exciton, and thereby, the EML generates a visible light.

The driving device may be implemented as a Thin Film Transistor (TFT) in a Metal Oxide Semiconductor Field Effect Transistor (MOSFET) structure. It is desirable to design the driving device has uniform electrical characteristics, such as a threshold voltage and mobility, in all pixels. However, due to a processing deviation and a device characteristic deviation, there may be a difference in electrical characteristics of a driving device between pixels. The electrical characteristics of a driving device may change as a driving time of a display passes. Such change in the electric characteristics of the driving device may cause afterimage in a screen of the organic light emitting display.

In order to compensate for an electrical characteristic deviation of the driving device, an internal compensation circuit or an external compensation circuit may be applied to the organic light emitting display. The internal compensation circuit is embedded in each pixel, samples a threshold voltage Vth of the driving device, which changes according to electrical characteristics of the driving device, and compensates a the gate-source voltage of the driving device as much as the threshold voltage Vth. The external compensation circuit senses a current or voltage of a pixel, which changes according to electrical characteristics of the driving device, based on the sensed current or voltage, the external compensation circuit modulates a data of an input image and thereby compensates for a deviation of electrical characteristics of driving devices between pixels.

SUMMARY

In order to implement an external compensation circuit, sensing pixels respectively connected to pixels, a sensing transistor for switching a sensing line, a switching circuit for switching a sensing path, an Analog-to-Digital Converter (ADC) for converting a sensing voltage to digital data, a sensing voltage supply, etc. are needed. Due to the external compensation circuit, a pixel aperture ratio is reduced.

It is possible to estimate degradation of pixels without a sensing circuit, but this may reduce accuracy in compensating for a degree of degradation of electrical characteristics.

Thus, the present disclosure provides an electroluminescent display capable of accurately compensating for a degree of degradation of pixels, and a driving method thereof.

An electroluminescent display according to the present disclosure includes: a display panel having data lines and scan lines intersecting with each other, and a plurality of pixels arranged thereon; a compensation device configured to generate a predicted value, which indicates a degree of degradation of pixels by accumulating pixel data of an input image at each pixel, generate a compensation value by adjusting the predicted value to a current measurement, which is obtained by measuring a current in a power line connected to the pixels, and generate compensation data by modulating the pixel data with the compensation value; and a display panel driving circuit configured to write the compensation data into the pixels.

A driving method of the electroluminescent display includes: generating a predicted value, indicating a degree of degradation of pixels, by accumulating pixel data of an input image at each pixel; generating a compensation value by adjusting the predicted value to a current measurement value which is measured by measuring a current in a power line connected to the pixels; generating compensation data by modulating the pixel data with the compensation value; and writing the compensation data into each pixel of the display panel.

BRIEF DESCRIPTION OF THE DRAWINGS

The accompanying drawings, which are included to provide a further understanding of the disclosure and are incorporated in and constitute a part of the application, illustrate aspects of the disclosure and together with the description serve to explain the principles of the disclosure.

In the drawings.

DETAILED DESCRIPTION

Figure 1:
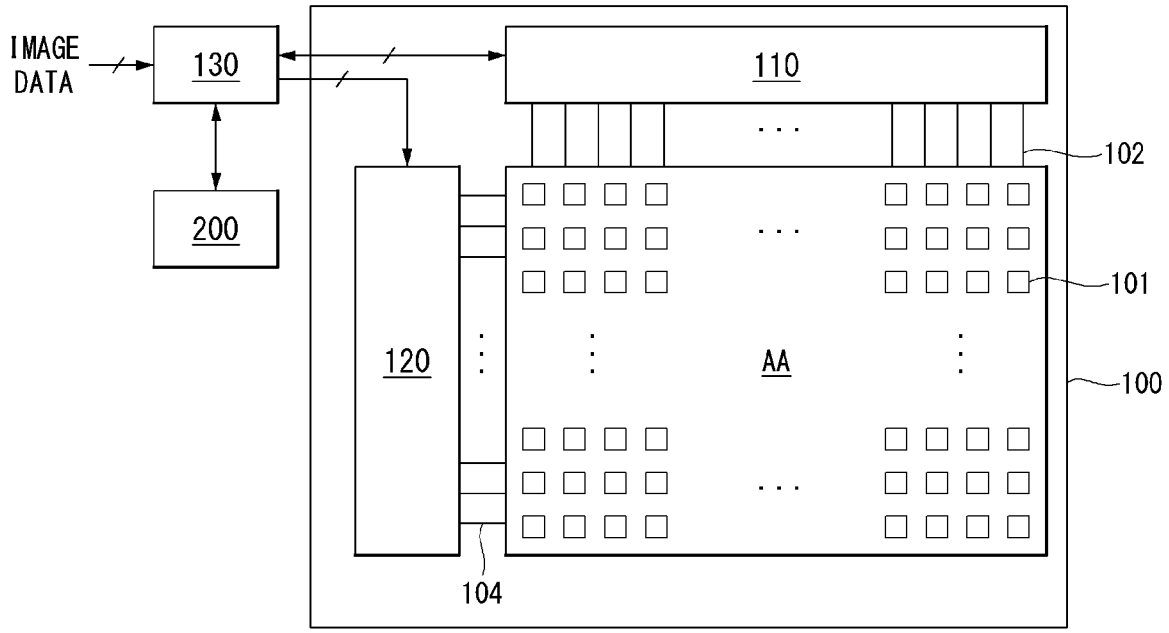
FIG. 1 is a block diagram illustrating an electroluminescent display according to an aspect of the present disclosure.

Advantages and features of the present disclosure and methods for achieving the advantages and features may become apparent from the aspects to be hereinafter described in conjunction with the drawings. However, the present disclosure is not limited to the aspects and may be embodied in various modifications. The aspects are provided merely to fully disclose the present disclosure and advise those skilled in the art of the category of the disclosure. The present disclosure is defined only by the appending claims. The same reference numbers denote the same elements throughout the specification.

The shapes, sizes, ratios, angles, numbers and the like disclosed in the drawings are exemplary and the aspect is not limited thereto. Like reference numerals refer to like elements throughout the specification. In the following description of the aspect, a detailed description of known related arts will be omitted when it is determined that the gist of the aspect may be unnecessarily obscured.

In the case where the terms "includes", "having", "done", etc. are used in this specification, other parts may be added unless "only" is used. As used herein, the singular forms "a," "an" and "the" are intended to include the plural forms as well, unless the context clearly indicates otherwise.

In interpreting the constituent elements, it is construed to include the error range even if there is no separate description.

In the case of a description of the positional relationship, for example, if the positional relationship between two parts is described as "on", "above", "under", or "next to" is not used, one or more other portions may be located between the two portions unless "immediately" or "directly" is used.

The first, second, and the like are used to describe various components, but these components are not limited by these terms. These terms are only used to distinguish one component from another. Therefore, the first component mentioned below may be the second component within the technical spirit of the aspect.

It is to be understood that the features of various aspects may be partially or entirely coupled or combined with each other and technically various interlocking and driving are possible, and that the aspects may be practiced independently of each other.

In the following, various aspects of the present disclosure will be described with the accompanying drawings. In the aspects, an electroluminescent display is described as an organic light emitting display including an organic light emitting material, but aspects of the present disclosure are not limited thereto.

Figure 2:
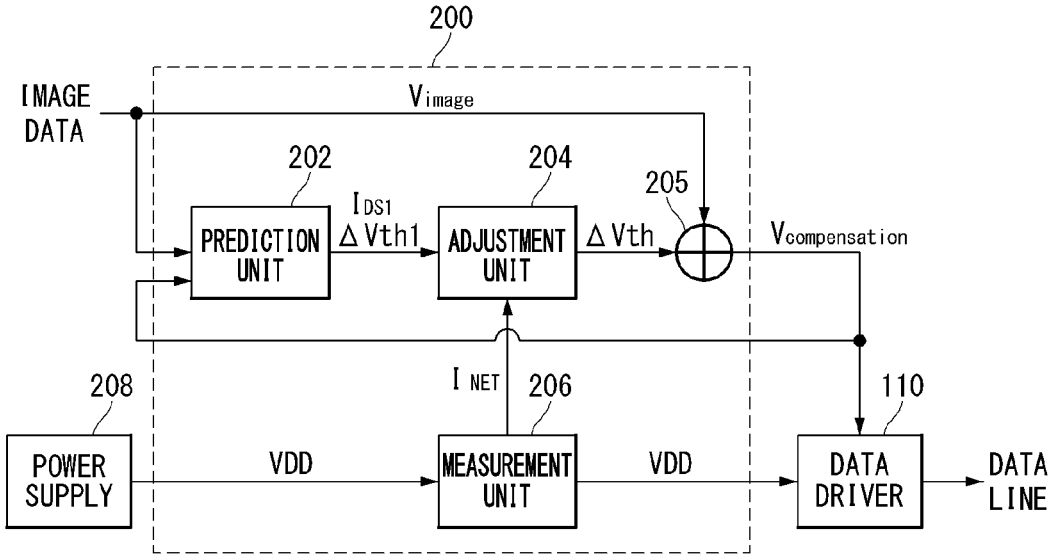
FIG. 2 is a detailed diagram illustrating a compensation device shown in FIG. 1.
Figure 3:
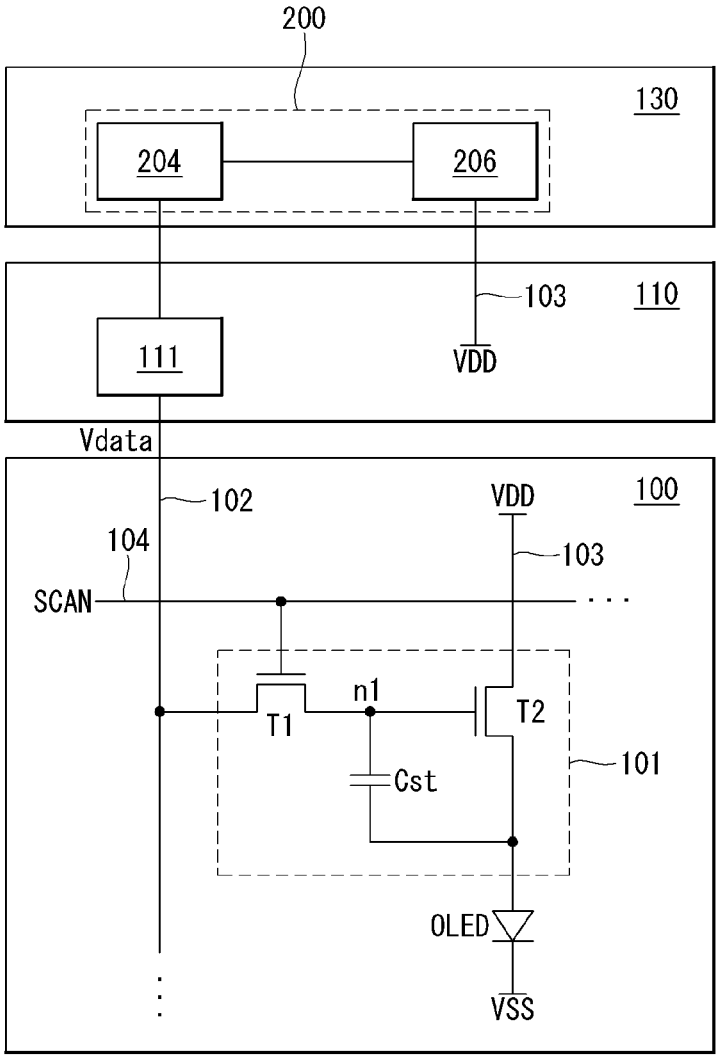
FIG. 3 is a diagram illustrating a measurement unit and a pixel circuit shown in FIG. 1.

FIG. 1 is a block diagram illustrating an electroluminescent display according to an aspect of the present disclosure. FIG. 2 is a detailed diagram illustrating a compensation device shown in FIG. 1, FIG. 3 is a diagram illustrating a measurement unit and a pixel circuit shown in FIG. 1.

Referring to FIGS. 1 and 2, an electroluminescent display according to an aspect of the present disclosure includes a display panel 100, a display panel driving circuit 110 and 120 writing data of an input image into pixels of the display panel 100, a timing controller 130 for controlling the display panel driving circuit 110 and 120, and a compensation device 200 for compensating for degradation of each pixel by modulating pixel data of an input image. The timing controller 130 and the compensation device 200 may be integrated into one IC chip.

A screen of the display panel 100 includes an active area AA displaying an input image. In the active area AA, a pixel array is arranged. The pixel array includes a plurality of data lines 102, a plurality of scan lines 104 intersecting with the data lines, and pixels arranged in a matrix form.

In order to implement an existing external compensation circuit, a display panel needs sensing lines connected to pixels, and a sensing transistor for switching the pixels. The external compensation circuit further needs a switching circuit for switching a sensing path, an Analog-to-Digital Converter (ADC) for converting a sensing voltage into digital data, a sensing voltage supply, etc. Compared with this, the present disclosure predicts a degree of degradation of each pixel, and precisely corrects a predicted value using an actual current measured on a power line of the display panel. Thus, sensing lines and a sensing transistor are removed from the display panel in the present disclosure, thereby increasing a pixel aperture ratio. In addition, it is possible to remove a switching circuit for switching a sensing path, an ADC for converting a sensing voltage into digital data, a sensing voltage supply, etc. from the external compensation circuit.

Each pixel may be separated into a red subpixel, a green subpixel, and a blue subpixel to realize color. Each pixel may further include a subpixel of other color including white. In the following, "pixel" may be interpreted as subpixel. Each subpixel 101 may be implemented as a pixel circuit which has the minimum configuration without an internal compensation circuit, as shown in FIG. 3.

The pixel circuit includes a first Thin Film Transistor (TFT) T1, a second TFT T2, an OLED, and a capacitor Cst, as shown in FIG. 3. The transistors T1 and T2 may be implemented as a TFT in an n-channel MOSFET.

The first TFT T1 is turned on in response to a scan signal SCAN to supply a data voltage Vdata from a data line 102 to a gate of the second TFT T2 and a capacitor Cst. The first TFT T1 includes a gate connected to a scan line 104 to which the scan signal is applied, a drain connected to the data line 102, and a source connected to a gate of the second TFT T2.

The second TFT T2 is a driving device for driving an OLED by adjusting a current of the OLED according to a gate-source voltage Vgs. The second TFT T2 includes a gate connected to a first node n1, a drain connected to a VDD line 103 to which a pixel driving voltage VDD is supplied, and a source connected to an anode of the OLED. The capacitor Cst is connected between the gate and the source of the second TFT T2 and charges a data voltage Vdata to maintain the gate-source voltage of the second TFT T2 during one frame period.

Touch sensors may be arranged on the display panel 100. A touch input may be sensed using additional touch sensors, or may be sensed using pixels. The touch sensors may be implemented as On-cell type or Add-on type touch sensors arranged on a screen of the display panel 100, or may be In-cell type touch sensors embedded in a pixel array.

The display panel driving circuit 110 and 120 includes a data driver 110 and a scan driver 120. A de-multiplexer which is not shown in the drawing may be arranged between the data driver 110 and the data lines 102. The de-multiplexer is arranged between the data driver 110 and the data lines and distributes a data voltage output from the data driver 110 to the data lines 102. Since one channel of the data driver 110 is connected by the de-multiplexer to a plurality of data lines, the number of data lines 102 may be reduced.

Under the control of the timing controller 130, the display panel driving circuit 110 and 102 writes compensation data, received from the compensation device 200, into pixels of the display panel 100 and displays an input image on a screen. The display panel driving circuit 110 and 120 may further include a touch sensor driver for driving touch sensors. The touch sensor driver is omitted in FIG. 1. In a mobile device or a wearable device, the data driver 110, the timing controller 130, and a power supply which is not illustrated may be integrated into one Integrated Circuit (IC). The power supply generates power required to drive the pixels and the display panel driving circuit 110 and 120.

The data driver 110 receives compensation data modulated by the compensation device 200. The data driver 110 converts compensation data of an input image into a gamma compensation voltage every frame period using a Digital-to-Analog Converter (DAC) to output a data voltage Vdata. The data voltage is supplied to pixels through the data lines 102. Reference numeral "111" in FIG. 3 indicates a DAC of the data driver 110.

The scan driver 120 may be implemented as a gate in panel (GI) circuit which is formed directly on a bezel area of the display panel 100 together with a transistor array of an active area. The scan driver 120 outputs a scan signal, which is synchronized with the data voltage output from the data driver, to the scan lines 104 under the control of the timing controller 130. The scan driver 120 sequentially supplies the scan signal to the scan lines 104 using a shift register.

The timing controller 130 receives a pixel data of an input image and timing signals synchronized with the pixel data from a host system which is not illustrated. The timing controller 130 controls operation timings of the data driver 110, the scan driver 120, and the compensation device 200 based on timing signals from the host system. The host system may be any one of a TV system, a set top box, a navigation system, a personal computer (PC), a home theater system, a mobile device, and a wearable device.

The compensation device 200 calculates a consumption amount of each pixel by accumulating pixel data of an input data, which changes in real time, at each pixel and predicts degradation of a driving device for each pixel based on the calculated consumption amount of each pixel. The compensation device 200 measures a current flowing in a power line connected to pixels. The power line may be a VDD line 103 connected to all pixels, as illustrated in FIG. 3. In addition, the compensation device 200 may determine a degree of compensation of each pixel using a current measured on the power line and a degradation predicted value. The compensation device 200 outputs compensation data by adding a final compensation value to the pixel data of the input image. The compensation data is transmitted to the data driver 110. The compensation device 200 may be embedded in the timing controller 130. A measurement unit 206 of the compensation device 200 may be implemented as a current integrator and an ADC in the timing controller 130. The ADC may be installed in the data driver 110.

The compensation device 200 does not need a sensing circuit including sensing lines connected to each pixel of the display panel, a sensing transistor, a sensing switch circuit, etc. The compensation device 200 precisely corrects a current with a predicted value for each pixel, thereby enabled to precisely correct degradation of the pixels. Thus, the present disclosure may increase an aperture ratio of pixels, reduce a manufacturing cost, and precisely correct degradation of the pixels, thereby enabled to extend the lifespan of the display.

FIG. 2 is a detailed diagram illustrating a compensation device shown in FIG. 1. FIG. 3 is a diagram illustrating a measurement unit and a pixel circuit shown in FIG. 2. In FIG. 1, Vimge, ΔVth, and $V_{compensation}$ indicate digital data.

Referring to FIGS. 2 and 3, the compensation device 200 includes a prediction unit 202, a measurement unit 206, an adjustment unit 204, and a compensation unit 205.

The prediction unit 202 receives pixel data of an input image, accumulates the pixel data at each pixel, calculates a consumption amount of each pixel, and predicts a degree of degradation of each pixel. The prediction unit 202 converts the consumption amount of each pixel into a threshold voltage predicted value ΔVth1, indicating a degree of degradation of a threshold voltage of the driving device T2 for each pixel, and predicts a current IDS1 of each pixel according to the pixel data based on the threshold voltage predicted value ΔVth1.

The power supply 208 supplies the pixel driving voltage VDD to the measuring unit 206 through the VDD line 103. The measurement unit 206 measures a current INET flowing in the VDD line 103 connected to the pixels. As illustrated in FIG. 3, the measurement unit 206 may be embedded in the timing controller 130. The current INET measured by the measurement unit 206 may be equivalent to a sum of currents actually flowing in all pixels of a screen AA.

The adjustment unit 204 corrects a degree of degradation of a driving device, calculated by the prediction unit 202, by reflecting an actual current and determines a compensation value ΔVth. The compensation value ΔVth determined by the adjustment unit 204 is a compensation value of a threshold voltage value of the driving device T2 of each pixel. The compensation unit 205 outputs compensation data $V_{compensation}$ by adding the compensation value ΔVth to the pixel data of the input image. The compensation data $V_{compensation}$ is transmitted to the data driver 110.

In another aspect, the compensation data $V_{compensation}$ may be input to the prediction unit 202. The prediction unit 202 may more precisely predict a degree of degradation of each pixel by adding compensation data, which is to be actually applied to pixels, to pixel data $V_{image}$ per pixel of an input image at each pixel.

Figure 4:
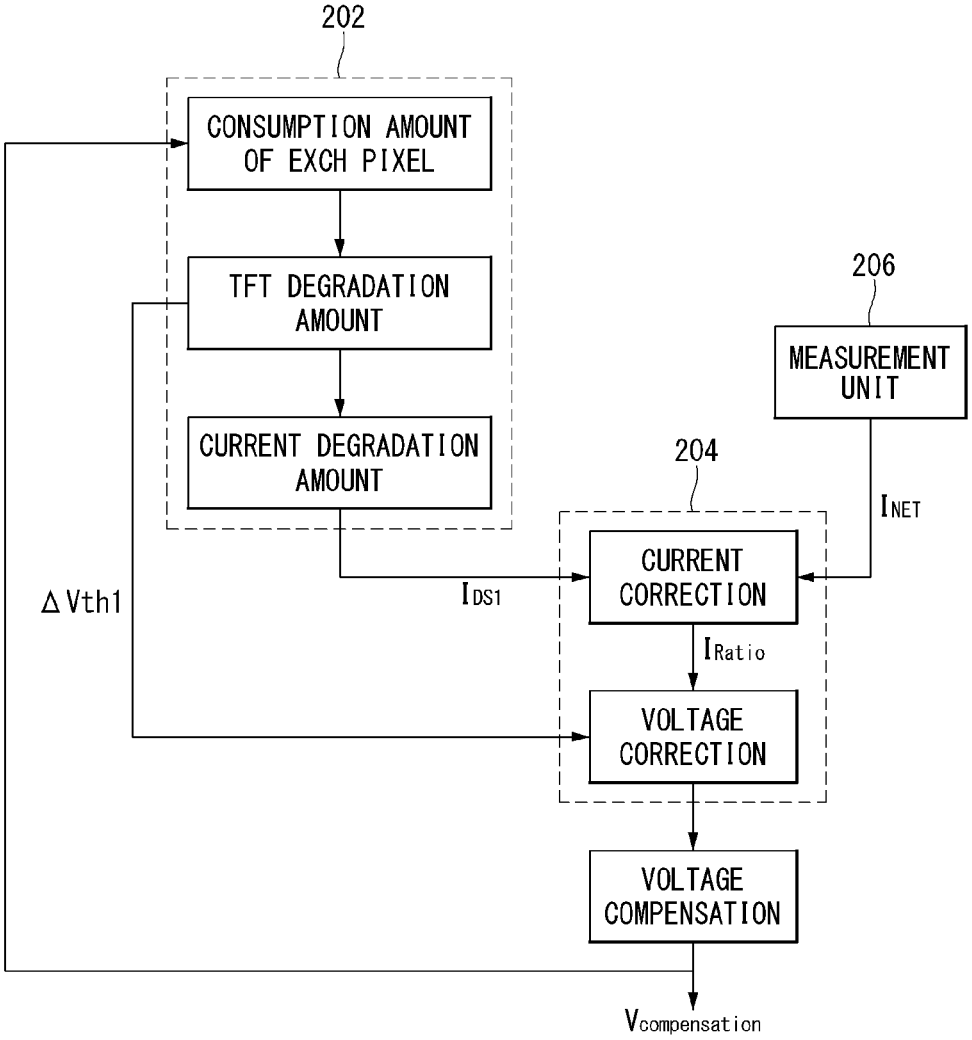
FIG. 4 is a detailed diagram illustrating a prediction unit and an adjustment unit shown in FIG. 2.

FIG. 4 is a detailed diagram illustrating the prediction unit 202 and the adjustment unit 204 shown in FIG. 2.

Referring to FIG. 4, the prediction unit 202 calculates a consumption amount of each pixel by accumulating pixel data of an input image at each pixel. Pixel data for each pixel may be accumulated in a memory until the lifespan of the pixels expires, but the accumulation time may be changed in consideration of a memory capacity. The prediction unit 202 calculates an amount of degradation of a driving device by converting a consumption amount of each pixel into a threshold voltage predicted value for each pixel ΔVth1, represented by Equation 1.

$$\Delta V_{th1}=A(1-\exp[-\tau^{\beta}]) \quad \text{[Equation 1]}$$

where A and β are parameters which are preset according to characteristics of a display device, and τ is a consumption amount of each pixel.

The prediction unit 202 calculates a current predicted value IDS1 per pixel. indicating a current variation per pixel, by substituting the threshold voltage predicted value ΔVth1 in Equation 2, as below.

$$I_{DS1}=\alpha(V_{image}-\Delta V_{th1}) \quad \text{[Equation 2]}$$

wherein $V_{image}$ is a pixel data of an input image.

In another aspect, the prediction unit 202 may more precisely predict a consumption amount of each pixel by adding compensation data, which is actually applied to pixels, to the pixel data of an input image at each pixel.

The adjustment unit 204 calculates a current ratio $I_{Ratio}$ of each pixel, which is about a current required for all pixels, by substituting the current predicted value $I_{DS1}$ of each pixel in the following Equation 3. The adjustment unit 204 performs current correction as in Equation 4 by multiplying the current ratio IRatio by a current INET measured by the measurement unit 206 to output a compensated current IDS2. Σxy IDS1 means a current IDS1 required for all pixels.

$$I_{Ratio} = \frac{I_{DS1}}{\sum_{xy} I_{DS1}} \quad \text{[Equation 3]}$$

$$I_{DS2} = I_{NET} \cdot I_{Ratio} \quad \text{[Equation 4]}$$

A relationship between a current of a pixel and a threshold voltage of a driving device is preset in the adjustment unit 204, as in Equation 5.

$$I_{DS2}=\alpha\cdot(V_{image}-V_{th2})^2 \quad \text{[Equation 5]}$$

wherein α is a parameter which is preset according to initial characteristics of a display. Vth2 is a a threshold voltage predicted from IDS2.

Equation 5 is changed into Equation 6 as below. The adjustment unit 204 adjusts a predicted value of a threshold voltage of a driving device by combining Vth2 into Vth1, as in Equation 7, thereby determining a compensation value ΔVth. Vth1 is a threshold voltage predicted from a consumption amount of each pixel. The compensation unit 205 adds the compensation value ΔVth to pixel data of an input image, and outputs compensation data $V_{compensation}$ to be written into pixels of the screen AA.

$$\log I_{DS2}=\log \alpha+2\cdot\log(V_{image}-V_{th2}) \quad \text{[Equation 6]}$$

$$\Delta V_{th}=V_{th1}+(1-c)\cdot V_{th2} \quad \text{[Equation 7]}$$

where c is a preset parameter.

As described above, the present disclosure predicts a degree of degradation of each pixel, and precisely corrects a predicted value with an actual current measurement value measured on a power line of a display panel, thereby enabled to accurately compensate for degradation of pixels without a sensing circuit connected to the pixels.

Thus, the present disclosure makes it possible to remove sensing lines connected to pixels, a sensing transistor, a sensing switch circuit, etc. from a display panel, thereby increasing an aperture ratio of the pixels, reducing a manufacturing cost, and extending the life span of a display by compensating for degradation of the pixels.

Although aspects have been described with reference to a number of illustrative aspects thereof, it should be understood that numerous other modifications and aspects can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electroluminescent display comprising:

a display panel having a plurality of data lines and a plurality of scan lines intersecting with each other, and a plurality of pixels arranged thereon;

a power supply configured to be separated from the display panel and supply a pixel driving voltage to a power line;

a compensation device configured to generate a predicted value indicating a degree of degradation of pixels by accumulating pixel data of an input image at each pixel, generate a compensation value by adjusting the predicted value to a current measurement obtained by measuring a current directly on the power line between the display panel and the power supply, and generate compensation data by modulating the pixel data with the compensation value; and a display panel driving circuit configured to write the compensation data into the plurality of pixels, wherein each of the pixels includes:

a light emitting element; and a driving element for driving the light emitting element, wherein the power line extends into the display panel and is connected to the driving element in all the pixels to supply the pixel driving voltage to the pixels.

2. The electroluminescent display of claim 1, wherein the compensation device includes:

a prediction unit configured to generate the predicted value based on a consumption amount of each pixel obtained by accumulating the pixel data of the input image at each pixel;

a measurement unit configured to measure a current flowing in the power line connected to the plurality of pixels;

an adjustment unit configured to compensate for the compensation value by reflecting a current measurement value, measured by the measurement unit, in the predicted value; and a compensation unit configured to generate the compensation data by adding the compensation value to the pixel data.

3. The electroluminescent display of claim 1, wherein the prediction unit converts the consumption amount of each pixel into a predicted value of a threshold voltage of a driving device which drives a light emitting device of a corresponding pixel, and calculates a current predicted value for each pixel based on the predicted value of the threshold voltage.

4. The electroluminescent display of claim 1, wherein the adjustment unit calculates a current ratio of the current predicted value to a sum of currents of all pixels of the display panel, adjusts the current predicted value by reflecting the current measurement to the current ratio, and determines the compensation value by converting the current predicted value into a compensation value of the threshold voltage.

5. A driving method of an electroluminescent display comprising a plurality of pixels including a driving element for driving a light emitting element, and a power line connected to the driving element in all the pixels to supply a pixel driving voltage to the pixels, the method comprising:

supplying the pixel driving voltage generated from the power supply to the power line;

generating a predicted value indicative of a degree of degradation of a plurality of pixels, by accumulating pixel data of an input image at each pixel;

generating a compensation value by adjusting the predicted value to a current measurement value measured by measuring a current directly on the power line between the power supply and the pixels;

generating compensation data by modulating the pixel data with the compensation value; and writing the compensation data into each pixel of the display panel.

6. The driving method of claim 5, wherein the generating of a predicted value comprises generating the predicted value based on a consumption amount of each pixel which is obtained by accumulating the pixel data of the input image at each pixel.

7. The driving method of claim 5, wherein the generating of compensation data comprises determining the compensation value by reflecting the current measurement value in the predicted value, and generating the compensation data by adding the compensation value to the pixel data.

8. The driving method of claim 6, wherein the generating of a predicted value comprises generating the predicted value based on the consumption amount of each pixel which is obtained by adding a result of adding the compensation data to the pixel data of the input image to each pixel.

9. The driving method of claim 6, wherein the generating of compensation data comprises determining the compensation value by reflecting the current measurement value in the predicted value, and generating the compensation data by adding the compensation value to the pixel data.

10. The driving method of claim 5, wherein the generating of a predicted value includes converting the consumption amount of each pixel into a predicted value of a threshold voltage of a driving device which drives a light emitting device of the pixels, and generating the predicted value by calculating a current predicted value for each pixel based on the predicted value of the threshold voltage.

11. The driving method of claim 5, wherein the generating of compensation data comprises generating a current ratio of the current predicted value regarding a sum of currents of all pixels of the display panel, adjusting the current predicted value for each pixel by reflecting the current measurement value in the current ratio, and determining the compensation value by converting the current predicted value for each pixel into the threshold voltage compensation value.

12. An electroluminescent display comprising:

a display panel having a plurality of data lines and a plurality of scan lines intersecting with each other, and a plurality of pixels including a driving element for driving a light emitting element and a power line connected to the driving element in all the pixels to supply a pixel driving voltage to the pixels, wherein sensing lines are not connected to the a plurality of pixels;

a power supply configured to be separated from the display panel and supply the pixel driving voltage to the power line; and a compensation device configured to:

generate a predicted value, indicating a degree of degradation of pixels, by accumulating pixel data of an input image at each pixel, generate a compensation value by adjusting the predicted value to a current measurement obtained by measuring a current directly on the power line between the display panel and the power supply, and generate compensation data by modulating the pixel data with the compensation value; and a display panel driving circuit configured to write the compensation data at each pixel.

13. The electroluminescent display of claim 12, wherein the compensation device includes:

a prediction unit generating the predicted value based on a consumption amount of each pixel obtained by accumulating the pixel data of the input image at each pixel;

a measurement unit measuring a current flowing in the power line connected to the plurality of pixels;

an adjustment unit compensating for the compensation value by reflecting a current measurement value, measured by the measurement unit, in the predicted value; and a compensation unit generating the compensation data by adding the compensation value to the pixel data.

14. The electroluminescent display of claim 13, wherein the prediction unit converts the consumption amount of each pixel into a predicted value of a threshold voltage of a driving device which drives a light emitting device of a corresponding pixel and calculates a current predicted value for each pixel based on the predicted value of the threshold voltage.

15. The electroluminescent display of claim 13, wherein the adjustment unit calculates a current ratio of the current predicted value to a sum of current of all pixels of the display panel, adjusts the current predicted value by reflecting the current measurement to the current ratio, and determines the compensation value by converting the current predicted value into a compensation value of the threshold voltage.

16. The electroluminescent display of claim 14, wherein the predicted value of the threshold voltage for each pixel ($\Delta V_{th1}$) is calculated by $\Delta V_{th1}=A(1-\exp[\tau^{\beta}])$, where A and $\beta$ are preset parameters according to characteristics of the electroluminescent display device, and $\tau$ is the consumption amount of each pixel.

17. The electroluminescent display of claim 14, wherein the current predicted value per pixel ($I_{DS1}$) is calculated by substituting the threshold voltage predicted value Vth1 from $V_{image}$ in $I_{DS1}=\alpha(V_{image}-V_{th1})$, where $V_{image}$ a pixel data of an input image and a is a preset parameter according to characteristics of the electroluminescent display device.

* * * * *